United States Patent [19]

Charbrol et al.

[11] Patent Number: 4,712,830

[45] Date of Patent: Dec. 15, 1987

[54] FOLDING CHAIR COMPRISING QUICK UNLOCKING MEANS

[75] Inventors: Jean-Jacques Charbrol, Gironde; Jean-Pierre Lambert, Indre-et-Loire, both of France

[73] Assignees: Composites Aquitaine S.A.; Etablissements Poirier S.A., both of Paris, France

[21] Appl. No.: 859,580

[22] Filed: May 5, 1986

[30] Foreign Application Priority Data

May 6, 1985 [FR] France ..... 85 06842

[51] Int. Cl.[4] ..... A61G 5/00

[52] U.S. Cl. ..... 297/42; 280/42; 403/328; 403/108

[58] Field of Search ..... 280/242 WC, 42, 650, 280/657, 646; 297/42, 43, 45; 403/328, 325, 108

[56] References Cited

U.S. PATENT DOCUMENTS

| | | | |
|---|---|---|---|
| 1,748,426 | 2/1930 | Pentland | 403/108 |
| 2,592,405 | 4/1952 | Everest et al. | 297/42 |
| 2,639,162 | 5/1953 | Schon | 280/42 |
| 2,896,693 | 7/1959 | Schladebach | 297/42 |
| 3,507,528 | 4/1970 | Desmarchais | 403/325 |
| 4,026,568 | 5/1977 | Hallam | 280/650 |
| 4,065,180 | 12/1977 | Karay | 297/384 |
| 4,390,300 | 6/1983 | Foster | 403/108 |

FOREIGN PATENT DOCUMENTS

| | | |
|---|---|---|
| 62842 | 6/1892 | Fed. Rep. of Germany . |
| WO85/01205 | 3/1985 | PCT Int'l Appl. . |
| 2125740 | 3/1984 | United Kingdom . |

*Primary Examiner*—John A. Pekar

*Attorney, Agent, or Firm*—Armstrong, Nikaido, Marmelstein & Kubovcik

[57] ABSTRACT

A folding chair is provided comprising means for holding the chair in the opened out position, which means are foldable, means for locking these holding means in the opened out position, which comprise a bar, a slide mounted for sliding on said bar and coupled to said holding means so as to prevent said holding means from folding up again when it occupies an end position along the bar and for allowing such folding up when it leaves this end position and slides along the bar, means for locking said slide in said end position and corresponding unlocking means. Said unlocking means comprises a rod, mounted for moving on the chair so as to be able to be brought into a position in which they cooperate with said locking means for unlocking said slide.

4 Claims, 3 Drawing Figures

FOLDING CHAIR COMPRISING QUICK UNLOCKING MEANS

BACKGROUND OF THE INVENTION

1. Field of the Invention

The present invention relates to a folding chair, more particularly a chair for handicapped people, which comprises quick unlocking means.

It relates more precisely to a folding chair comprising means for holding the chair in the unfolded or opened out position which are foldable, means for locking these holding means in the opened out position, which comprise a bar, a slide mounted for sliding on said bar and coupled to said holding means so as to prevent these holding means from folding up when it occupies an end position along the bar, and for allowing such folding up when it leaves this end position and slides along the bar, means for locking said slide in said end position and corresponding unlocking means.

2. Description of the Prior Art

Such a chair is for example known from the documents U.S. Pat. No. 2,896,693. The means for locking the slide F may comprise a push button which penetrates into openings formed in the bar C. As for the means for unlocking the slide, they have not been described.

A priori, for unlocking the slide in order to fold up the chair, said push button needs to be operated. Now, access to this push button which is situated under the seat of the chair is difficult for the user, especially when it is a handicapped person.

The aim of the invention is to provide a folding chair of the above described type, which may be very easily unlocked in order to fold it up.

SUMMARY OF THE INVENTION

According to the invention, said unlocking means comprise a rod movably mounted on the chair so as to be able to be brought into a position in which it cooperates with said locking means for unlocking said slide.

Advantageously, said bar is hollow, said rod being disposed inside the bar so as to be able to slide longitudinally.

Preferably, the means for locking the slide comprise a retractable stud carried by the slide and projectable inside the bar through an opening disposed in line with said end position of the slide, the rod having one end adapted for pushing said stud out of the bar when it is moved along the bar.

Advantageously, said rod is returned resiliently in a direction opposite said means for locking the slide and is extended, at its end opposite said locking means, outside the bar by a pusher.

In a preferred embodiment of the chair, this latter has two sides, the means for holding the chair in the opened out position comprise two connecting elements spaced apart from each other and by which said sides are connected together, each connecting element comrpising two portions hinged to each other at a first common end, each portion being moreover connected hingedly to one of said sides by its other end, said bar extending between said connecting elements and being connected hingedly to said common ends of said portions, said slide being coupled to one of said connecting elements by means of two coupling elements which are each hinged by one end to said slide and by another end to one of the hinging points of said connecting element on the sides of the chair.

Preferably, said bar extends longitudinally with respect to the chair, the end of said rod opposite said locking means being turned towards the front of the chair.

BRIEF DESCRIPTION OF THE DRAWINGS

Other details and advantages of the invention will be clear from the following description of an embodiment given by way of non limitative example, with reference to the accompanying drawings in which.

DESCRIPTION OF THE PREFERRED EMBODIMENT

Figure 2:
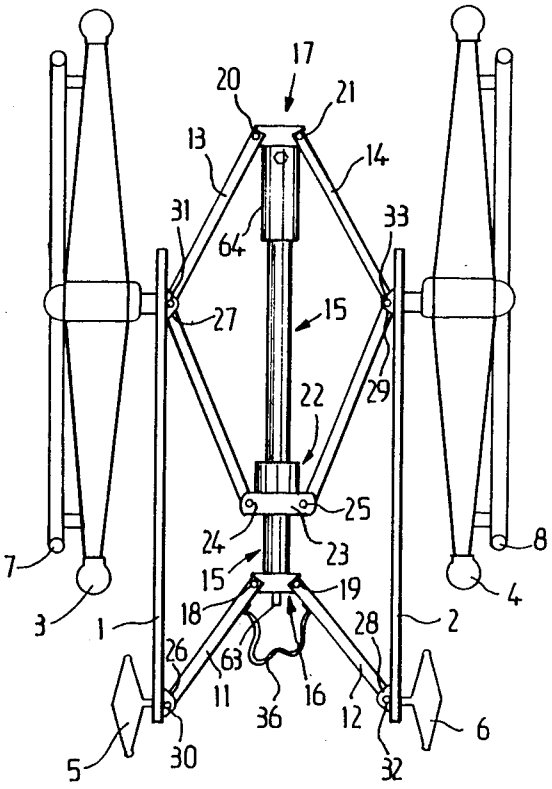
FIG. 2 is a top view of the chair of FIG. 1, in the partially folded up position.

The chair shown in the Figures comprises two parallel sides 1, 2 to each of which are fixed a rear wheel of large diameter 3, 4 and a front wheel of small diameter 5,6. A "handrail" 7,8 is fixed to each of the rear wheels 3,4. In what follows, the vertical direction will be defined as being the one perpendicular to the bearing plane of the wheels of the chair on the ground.

Each side 1,2, comprises at the front and at the rear, and on the inside of the chair situated between the two sides, a fork joint 26, 27 and 28, 29 receiving a vertical shaft 30, 31 and 32,33.

The chair is foldable and has means for holding it in the opened out position which comprises a front connecting element 9 and a rear connecting element 10 each formed of two portions 11, 12 and 13, 14.

The chair further comprises a bar 15 disposed in the longitudinal median plane of the chair, parallel to the sides 1,2. This bar comprises more particularly at each end a double fork joint 16,17 each supporting two vertical shafts 18, 19 and 20, 21. The two shafts of each double fork 16, 17 are disposed in a common plane perpendicular to bar 15.

On bar 15 is slidably mounted a slide 22 which itself comprises a double fork joint 23 carrying two vertical shafts 24, 25. These shafts are disposed in a common plane perpendicular to bar 15.

The two portions 11, 12 of the front connecting element 9 are respectively hinged, on the one hand, to shaft 30, 32 of the adjacent side 1, 2 and on the other to the front double fork joint 16 of bar 15, more precisely to the shaft 18,19.

The same goes for the two portions 13, 14 of the rear connecting element 10 which are respectively hinged to the shaft 31, 33 of the adjacent side and on the other hand to the shaft 20, 21 of the rear double fork joint 17 of bar 15.

Slide 22 is coupled to the rear connecting element 10 by means of two coupling elements 34, 35 which are hinged respectively, on the other hand, to the shaft 24, 25 of the double fork joint 23 of slide 22 and on the other to the shaft 31, 33 of the adjacent side 1,2.

Sides 1, 2, the connectng elements 9, 10 and the coupling elements 34, 35 are , in this embodiment, rigid polygons which extend in vertical planes.

Figure 1:
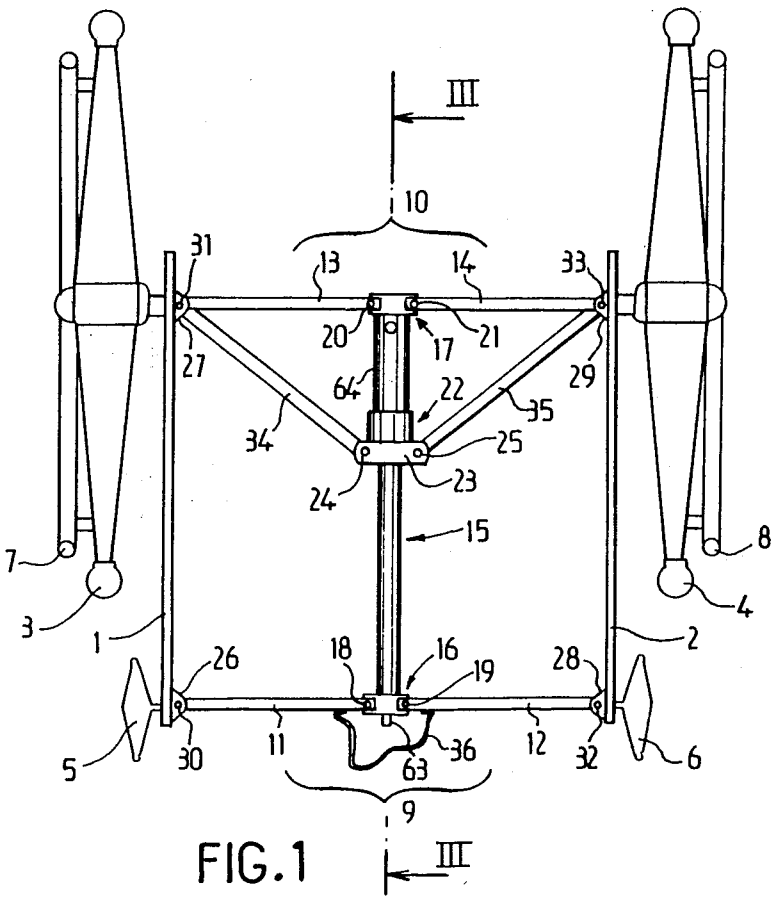
FIG. 1 is a top view of a folding chair according to the invention, in the opened out position.

Such as shown in FIG. 1, slide 22 occupies a rear end position along bar 15 in which it is immobilized by means of locking means described hereafter. The connecting elements 10 then form with the two coupling elements 34, 35 an indeformable triangle holding the two sides 1, 2 of the chair spaced apart from each other. The two portions 11, 12 and 13, 14 of each connecting element extend in the extension of each other, perpendicularly to the sides 1, 2.

When slide 22 is unlocked in the way described hereafter, the user may manually draw the two sides 1, 2 of the chair together by pushing bar 15 rearwardly, the slide 22 moving forwardly (FIG. 2) as far as a position in which the two sides 1, 2 are juxtaposed.

A strap 36 is fixed by one its ends respectively to portion 11 and to portion 12 of the connecting element 9, in the vicinity of bar 15, and allows a pull to be exerted on the bar, which is directed forwardly, for again opening out the chair.

Figure 3:
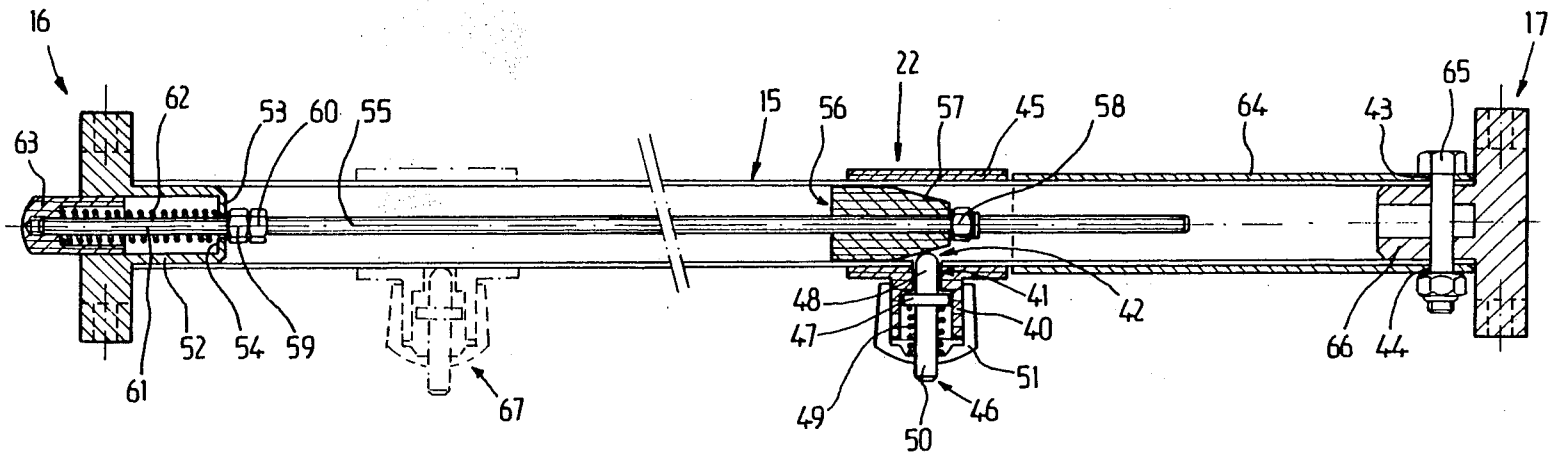
FIG. 3 is a partial enlarged view in longitudinal section through line III—III of FIG. 1.

The means for locking slide 22 will be described with reference to FIG. 3. Bar 15 is a hollow cylindrical tube which has, at a given position along the bar—namely in line with said rear end position of slide 22—an opening 42 and, in the vicinity of the rear end, two opposite openings 43, 44.

Slide 22 comprises a cylindrical socket 45 which carries said double fork joint 23 not shown in this FIG. as well as a tubular extension 40 extending vertically downwards and opening inside the slide 22 through an opening 41 of a diameter smaller than the inner diameter of said tubular extension 40.

A cylindrical stud 46 is housed in the tubular extension 40 of slide 22. It has a shoulder 47 in its median part and a rounded end 48 penetrating inside the slide 22.

A helical spring 49 is fitted on the other end 50 of stud 46. A cap 51, through which said other end 50 passes, covers said tubular extension 40.

Thus, with spring 49 bearing on the one hand on cap 51 and on the other on the shoulder 47 of stud 46, the stud is returned resiliently inwardly of the slide.

Slide 22 thus equipped is fitted on bar 15, for this stud 46 being pushed outwardly of slide 22. When slide 22 is in line with the opening 42 in bar 15, stud 46 snaps inside this opening: the slide is then locked.

The means for unlocking slide 22 will now be explained. The front double fork joint 16 of bar 15 is hollow and is extended transversely by a tubular part 52. This tubular part 52 comprises a bottom 53 which has a central opening 54. The double fork joint 16 is fitted by its tubular part 52 in the front end of bar 15 and it is held there for example by bonding.

The unlocking means properly speaking comprise a rod 25 threaded over the whole of its length, which has an end piece 56 in the neighborhood of its rear end. This end piece 56 is cylindrical and ends, at its end directed rearwardly of the chair, in a truncated cone shaped part 57. The outer diameter of end piece 56 is very slightly less than the inner diameter of bar 15. End piece 56 comprises an inner axial thread so that it may be screwed on rod 55. It is locked in an axial position along the rod by means of a lock nut 58.

In the vicinity of its front end 61, rod 55 has a nut 59 locked in the axial position by a lock nut 60. Rod 55 thus equipped is fitted in bar 50 through the rear end thereof. It passes through the bottom 53 of the front double fork joint 16, whereas the nut 59 and its lock nut 60 abut against this bottom.

On the front end 61 of rod 55 is fitted a helical spring 62, then a pusher in the form of a cap 63 is screwed on rod 55. Spring 62 therefore bears on the bottom 53 and exerts a thrust on pusher 63, that is to say on rod 55, this thrust being directed forwardly of the chair. The axial position of end piece 56 is adjusted so that with its truncated cone shaped part 57 it is flush with stud 46.

Abutment means are preferably provided so that, when the chair is opened out, it is immobilized in its opened out position (FIG. 1), and so that there is no risk of it folding up again in the reverse direction. It this embodiment,these abutment means comprise a tube 64 whose length is equal to the distance between slide 22—when it is locked—and the rear end of bar 15. This tube 64 caps bar 15 externally and so prevents slide 22 from sliding further towards the rear of bar 15, beyond its locking position.

The rear double fork joint 17 of bar 15 comprises a transverse tubular portion 66 by which it is fitted into bar 15.

Tube 64 and the rear double fork joint 17 of bar 15 are fixed thereto by means of a bolt 65 passing transversely through the tube 64, bar 15 and the tubular portion 66 of the rear fork joint 17.

In use, with the chair locked in the opened out position (FIGS. 1 and 3), the user of the chair may unlock it by exerting a simple rearwardly directed pressure on pusher 63. End piece 57 (FIG. 3) by its truncated cone shaped part 57 then its cylindrical part then pushes stud 46 inside the tubular extension 40 of slide 2. At the same time, the user must exert a thrust on the sides 1, 2 of the chair so as to draw them close together. This thrust on sides 1, 2 tends to move slide 22 forwardly: the rounded end 48 of stud 46 allows this latter to come out of the opening 42 in bar 15. Such as shown in FIG. 2, the chair is in a partially folded up position. At the end of folding up the chair, slide 22 occupies a position 67 shown with a dash dot line in FIG. 3.

For again opening out the chair, the user only needs manually move the two sides 1, 2 apart which causes slide 22 to slide towards its rear locked position. As soon as slide 22 abuts against tube 64, its stud 46 is in line with the opening 42 in bar 15 and snaps into the bar for locking slide 22.

It will be noted that the means for locking the slide are such that it is not necessary to reset them after unlocking them: a simple thrust moving the two sides 1, 2 of the chair apart causes locking again.

Moreover, it should be noted that rod 55 (FIG. 3) could in a variant not shown be controlled from the rear of the chair, because of the symmetry of the locking means with respect to a plane perpendicular to bar 15 passing through stud 46. IT would be sufficient to return the whole of the unlocking means from the front rearwardly, the rod extending into the bar from its rear end and unlocking of the slide being caused by a thrust on the pusher directed towards the front.

Naturally, the invention is not limited to a chair in which rod 55 for unlocking the slide is situated in bar 15; it also concerns all variants in which rod 55 is mounted for moving on the chair in a different way, this rod being in all cases brought into a position for cooperation with the means for unlocking the slide.

What is claimed is:

1. In a folding chair comprising means for holding the chair in the opened out position, which are foldable, means for locking said holding means in the opened out position, which comprise a hollow bar, a slide mounted for sliding on said bar and coupled to said holding means so as to prevent said holding means from folding up against when said holding means occupies an end position along the bar, and for allowing folding when said holding means leaves said end position and slides along said bar, means for locking said slide in said end position and means for unlocking said slide, said unlocking means comprise a rod, mounted in said hollow bar and longitudinally slidable therein for movement on the chair so as to be able to be brought into a position in which said unlocking means cooperates with said locking means for unlocking said slide, said means for locking said slide comprise a retractable stud carried by said slide and being projectable inside said bar through an opening disposed in line with said end position of said slide, said rod having an end arranged for pushing said stud out of said bar when said rod is moved along the bar.

2. The chair as claimed in claim 1, wherein said rod is returned resiliently in a direction opposite said means for locking said slide and is extended, at its end opposite said locking means, outside the bar by a pusher.

3. The chair as claimed in any one of claim 1 or claim 2, comprising two sides, said means for holding the chair in the opened out position comprise two connecting elements spaced apart from each other and by which said sides are connected together, each connecting element comprising two portions hinged with respect to each other at a first common end, each portion being further hingedly connected to one of said sides by its other end, said bar extending between said connecting element and being hingedly connected to said common ends of said portions, said slide being coupled to one of said connecting elements by means of two coupling elements which are hinged by one end to said slide and by another end to one of the hinging points of said connecting element on the sides of the chair.

4. The chair as claimed in any one of claim 1 or claim 2, wherein said bar extends longitudinally with respect to the chair, the end of said rod opposite said locking means being turned towards the front of the chair.

* * * * *